US007410171B1

(12) United States Patent
Holmdal

(10) Patent No.: US 7,410,171 B1
(45) Date of Patent: Aug. 12, 2008

(54) HEAD TO HEAD CHALLENGE CARD GAME

(76) Inventor: Jon Holmdal, 303 Cyanide St., Lead, SD (US) 57754

( * ) Notice: Subject to any disclaimer, the term of this patent is extended or adjusted under 35 U.S.C. 154(b) by 312 days.

(21) Appl. No.: 11/187,375

(22) Filed: Jul. 22, 2005

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 4,089,527 | A * | 5/1978 | Roth | 273/249 |
| 5,403,014 | A * | 4/1995 | Anema et al. | 273/292 |
| 5,947,821 | A * | 9/1999 | Stone | 463/13 |
| 6,179,291 | B1 * | 1/2001 | Vancura | 273/292 |
| 6,517,072 | B1 * | 2/2003 | McInerney | 273/236 |
| 6,877,748 | B1 * | 4/2005 | Patroni et al. | 273/292 |
| 6,896,265 | B1 * | 5/2005 | Schlumbrecht | 273/292 |
| 7,246,799 | B2 * | 7/2007 | Snow | 273/292 |
| 2005/0082760 | A1 * | 4/2005 | Yoseloff et al. | 273/292 |
| 2006/0232012 | A1 * | 10/2006 | Boyer | 273/292 |
| 2006/0284376 | A1 * | 12/2006 | Snow | 273/292 |
| 2007/0129128 | A1 * | 6/2007 | McClintic | 463/9 |

OTHER PUBLICATIONS

Scarne's Encyclopedia of Games, 1973, Harper & Row—pp. 6-32.*

* cited by examiner

*Primary Examiner*—Gene Kim
*Assistant Examiner*—Dolores Collins
(74) *Attorney, Agent, or Firm*—Jeffrey A. Proehl; Woods, Fuller, Shultz & Smith PC

(57) ABSTRACT

A method of playing a card game which includes providing at least one of the players with a challenge device to increase the amount waged in a game, and playing a hand comprises dealing cards to each player, and the placing of bets by the players. A second player, before he or she has viewed the identities of his or her cards, may present the first player with the challenge device to thereby increase the initial wager. The first player may accept or refuse the challenge device, and if the challenge device is refused by the first player, the first player forfeits the initial wager, and any subsequent wagers, and the game is ended. If the challenge device is accepted by the first player, the wager of both the first and second players is increased by the appropriate amount, and play of the game continues.

20 Claims, 4 Drawing Sheets

HEAD TO HEAD CHALLENGE CARD GAME

BACKGROUND OF THE INVENTION

1. Field of the Invention

The present invention relates to poker-based card games and more particularly pertains to a new head to head challenge card game for providing a challenging and fast paced card game.

2. Description of the Prior Art

Cards games are well known and myriad in implementation. However, the pace of some card games, such as Texas hold 'em, can be somewhat slow compared to other games. Since the take of the gambling establishment on such games can be fairly small, the relatively slow pace can further reduce the profitability of the game to the establishment as a result of the small take spread over a relatively long period of each game. Thus, despite the relative popularity of the Texas hold 'em game, the game is less profitable to gaming establishments than other games.

Thus, there is a need for a method of playing a hold 'em type card game that plays faster, and can result in higher profitability to the gaming establishment in which it is played.

SUMMARY OF THE INVENTION

In view of the foregoing disadvantages inherent in the known types of card games now present in the prior art, the present invention provides a new head to head challenge card game wherein the same can be utilized for providing a challenging and fast paced card game.

To attain this, the present invention generally comprises a method of playing a card game which includes making a challenge device available to at least one of the players to increase the amount waged in the game, and playing a hand comprises dealing cards to each player, and the placing of bets by the players. One of the players, before he or she has viewed the identities of his or her cards, may present the other player with the challenge device to thereby increase the players' initial wagers. The player may accept or refuse the challenge device, and if the challenge device is refused, that player forfeits the initial wager and any subsequent wagers and the game is ended. If the challenge device is accepted, the wagers of both players are increased by the appropriate amount, and play of the game continues.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability of one player to challenge the other player, and if the challenge is refused, the game is ended, which quickens the pace of the game and can cause the game to be concluded in a shorter period of time. Shorter periods of play can increase the profitability of the game to gaming establishments.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
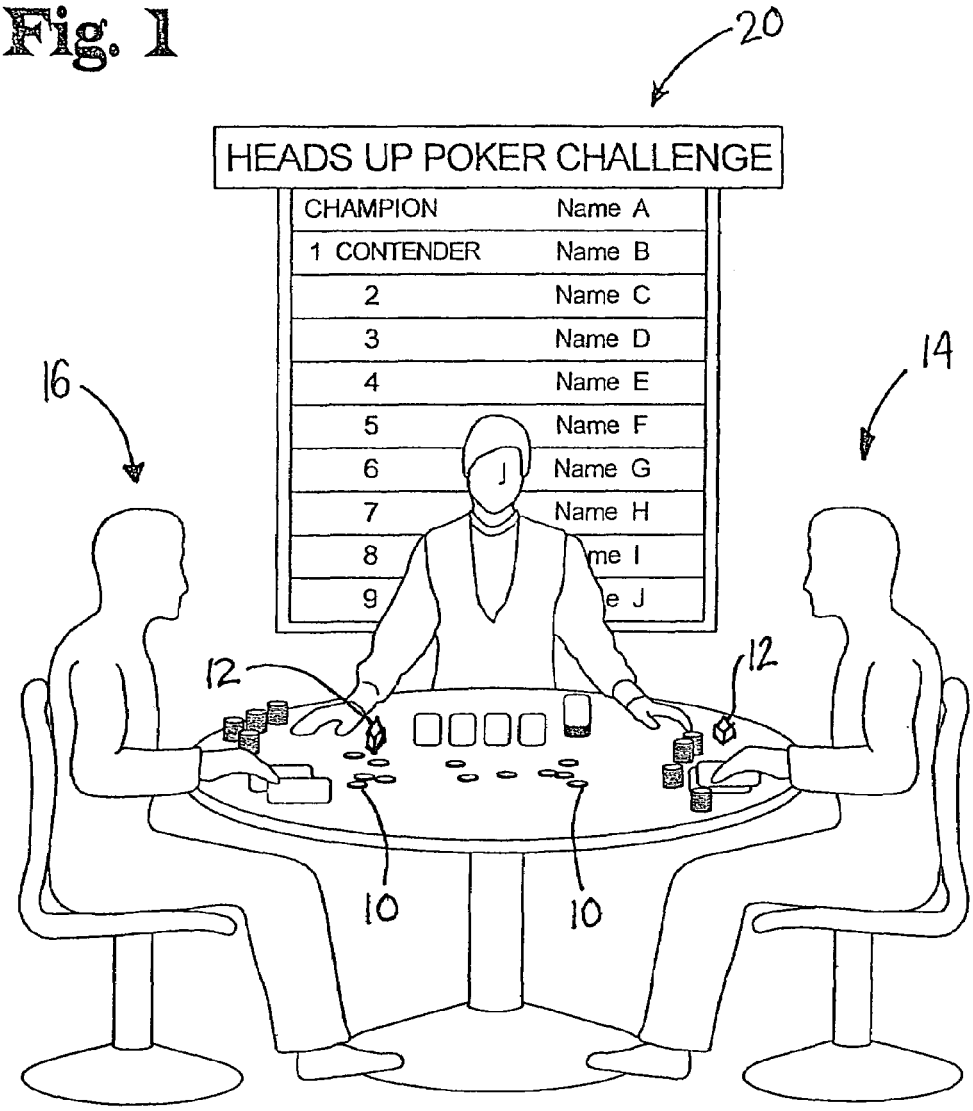
FIG. 1 is a schematic view of players engaged in playing the game of the present invention.
Figure 2:
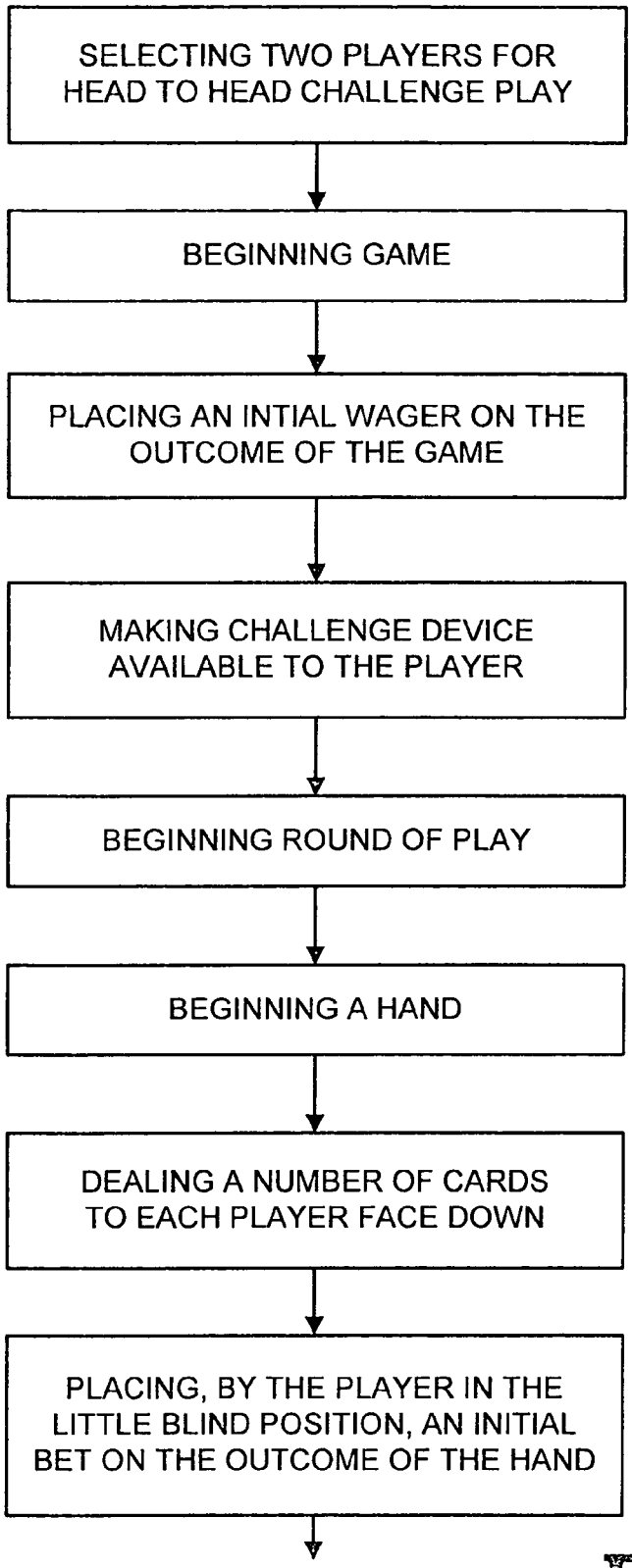
FIG. 2 is a schematic flow chart of a first portion of the method of play of the present invention.
Figure 3:
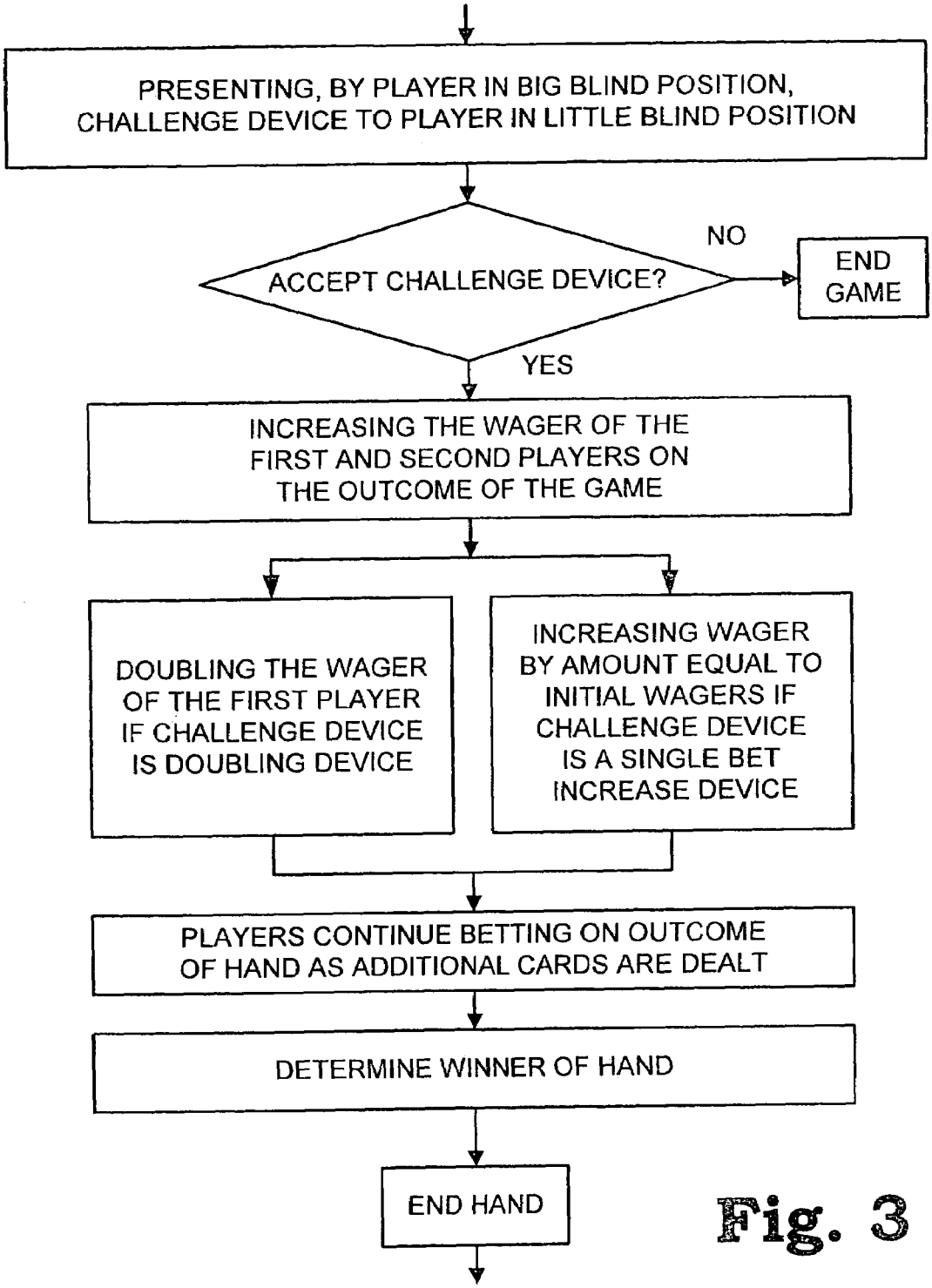
FIG. 3 is a schematic flow chart of a second portion of the method of play of the present invention.
Figure 4:
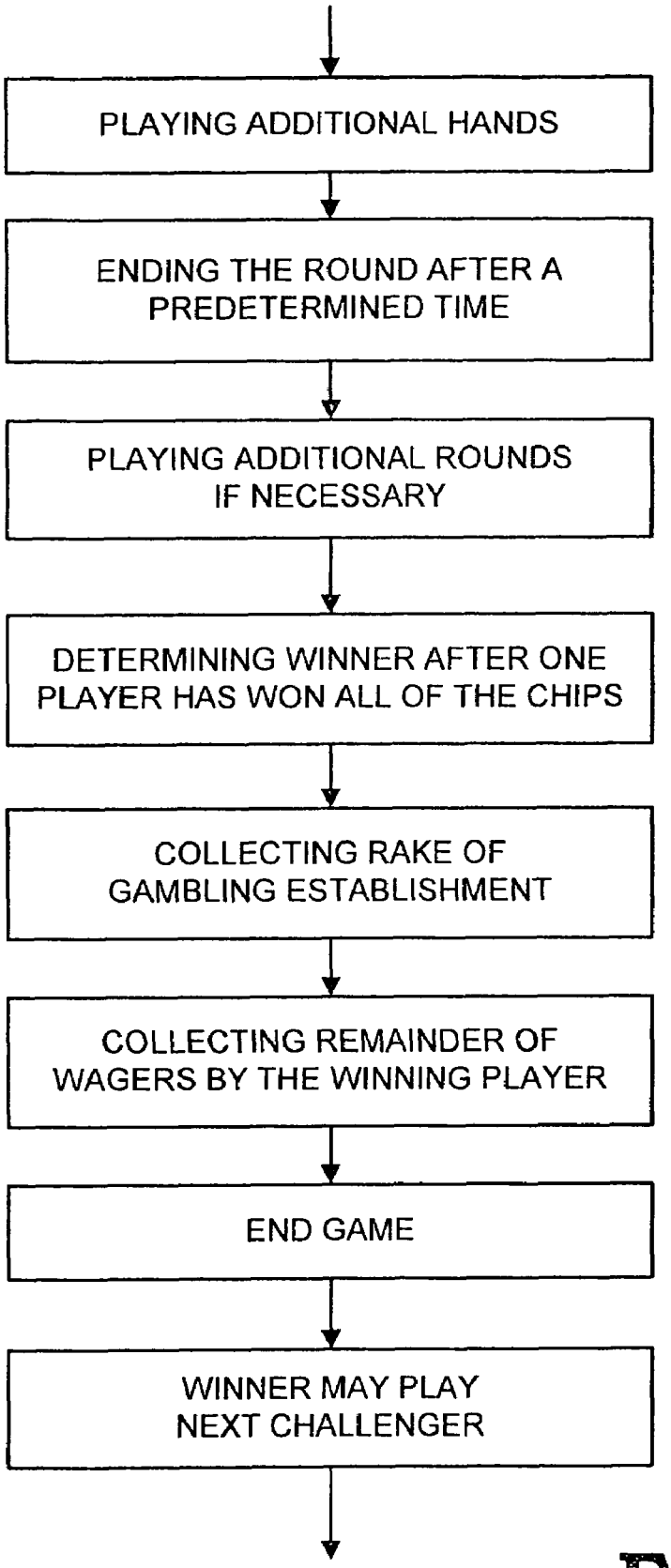
FIG. 4 is a schematic flow chart of a third portion of the method of play of the present invention.

With reference now to the drawings, and in particular to FIGS. 1 through 4 thereof, a new method of playing a card game implementing the principles and concepts of the present invention will be described.

The invention is primarily directed to a method of playing a game of poker, and while the game is preferably practiced in the form of Texas hold 'em poker, and will be illustratively described in the context of hold 'em poker, it may also be implemented in the play of other games as will be mentioned later in this description. The invention may also be implemented in a game apparatus, which will also be further described later in this description.

In the method implementation of the invention, the game is preferably, but not necessarily, played in a challenge or head-to-head format in which two players play each other until a winner is determined. Optionally, the game may be played with more than two players in a non-head-to-head format. The winner of a game may move on to play another player in a head-to-head challenge, which player is first on a list of players wishing to play the game.

One game of the method of the invention may comprise one or more rounds, and each round may comprise one or more hands. The two players involved in the game may utilize a dealer who deals the cards to the players, and a first one of the players may be in a little blind position to the left of the dealer button and a second one of the players may be in a big blind position with respect to the first player. Each of the players places an initial wager on the game that is equal to the other player's initial wager, and the winner of the game wins the initial wagers of both players. Each of the players may be provided with an equal predetermined number of wagering chips 10, or other representation of value or money for placing bets during the game.

At least one of the players, and optionally both players, is provided with a challenge device 12 to increase the players' initial wagers and thereby increase the amount being waged in the game. The challenge device may be an object, or other representation, of the prerogative or power of a player within the context of the game, and preferably signifies the prerogative to significantly increase or raise the amount being waged by the players in the game. The challenge device may comprise a doubling device that represents the prerogative to double the amount of an initial wager and any subsequent wagers made by the players on the outcome of the game. The doubling device is useful in those playing situations where the wager amounts can be doubled, for example, without violating bet limits or restrictions. The challenge device may optionally comprise a single bet increase button for increasing the amount of the initial wager by a predetermined amount, which is useful in playing situations where bet limits or restrictions prevent the doubling of the wager. The distinction between the doubling device and the single bet increase button is not necessarily physical, but is in the particular prerogative that its possession confers on the holder of the device. In either implementation, the device may comprise a relatively large six-sided die with imprints on each of its sides which may be employed to indicate (by the value on the side that is turned upwardly) the number of times that the wager has been increased using the device. However, other physical embodiments may be employed for the device.

When a round of play is initiated, it may last for a predetermined period of time, such as, for example, approximately fifteen minutes. Each round may have different characteristics, such as for example, the values of the blinds, or minimum wagers, of each round. Illustratively, during a first round of play, the small or little blind may have a value of 100 and the large or big blind may have a value of 200, and during a second or subsequent round the little blind may have a value of 200 and the big blind may have a value of 400. In the illustrative implementation, during a third round of play the little blind may have a value of 300 and the big blind may have a value of 600, and during a fourth round of play, the little blind may have a value of 400 and the big blind may have a value of 800. These values are illustrative only, and those skilled in the art will recognize that other values may be used.

As noted previously, each round may comprise a plurality of hands. Each hand may include the step of dealing a number of cards to each player, and the cards dealt are positioned face down. In one implementation of the invention, each player is dealt two cards.

Once the initial cards have been dealt, the player in the little blind position 14, who will for the purposes of this description be referred to as the first player, places a bet using the chips provided to the players at the beginning of the game. The first player may or may not look at the cards that have been dealt to him or her prior to placing the initial bet on the outcome of the hand.

The player in the big blind position 16, who will for the purposes of this description be referred to as the second player, may present the first player with the challenge device 12, to signify the raising of the initial wager on the outcome of the game by the first player by an amount that is, for example, double the initial wager or increased by a predetermined amount, according to the rules of the particular establishment or rules agreed to prior to the playing of the game. Preferably, the presentation of the challenge device by the second player to the first player occurs before either player has viewed his or her cards.

Once the second player has presented the first player with the challenge device 12, the first player may accept or refuse the challenge device. Depending upon the rules established by the establishment or agreed to prior to the game, the first player may be given the option to view the identities of the cards that have been dealt to the first player before deciding whether to accept or refuse the challenge.

If the challenge device presented by the second player is refused by the first player, the first player forfeits the initial wager and any subsequent wagers and the game ends. Another game against another player may then be initiated.

If the challenge device presented by the second player is accepted by the first player, the initial wagers of both the first and second players are increased by the appropriate amount. Play of the hand is continued, and the first player may retain the challenge device for future use during the round.

As is characteristic of Texas hold 'em poker, after dealing two cards to each of the players, a number of cards may be dealt by the dealer to a hand or pool of community cards, which are typically placed on the table in view of both of the players. At least one of the community cards, and optionally all of the community cards, are turned over to reveal the identity of the community card or cards. In some embodiments of the invention, the number of community cards is five, and in some embodiments three of the community cards are turned over so that the players can view the cards after the initial betting is completed. As play continues, a second bet may be placed by each of the players, or one of the players may fold as desired. If all of the community cards have not been turned over previously, an additional one or more of the community cards may be turned over to reveal the identity of the additional community card or cards. As play further continues, a third wager may be placed by each of the players. Again, if any of the community cards have not all been turned face up by this time, one or more additional community cards may be turned over to reveal the identity or identities. The players may then place a final bet on the outcome of the hand, and the hands of the players are thus revealed to determine a winner of the hand.

A new hand may then be initiated between the pair of players, as well as successive hands. The round may end upon one of the players winning all of the chips of the players, or upon the expiration of the predetermined time period. If a winner of the game has not been determined in the previous round, a new round may be initiated. The game may thus end once one player has lost all of his or her chips, or, of course, when one of the players refuses the challenge device.

Optionally, the gambling establishment or dealer may be provided with a portion of a total of the wagers for the game, and the portion may be according to a predetermined percentage of the total wager. The winner may then be provided with the remainder of the total wager (e.g. the total wager minus the cut for the establishment).

When the game ends and a winner of the game has been determined, the winning player may challenge another player, such as the next player that is listed on a challenge board 20 that lists players wishing to play the game.

It should be realized that the inventive aspects of the aforedescribed game may be implemented in other games of variations, such as, for example, Omaha (Hi), Omaha (Hi/Lo), pineapple, crazy pineapple, five card stud, razz, seven card stud, draw poker, and the like. Optionally, the challenge aspect of the game may be played in a plurality of geographically remote locations.

Further, the method of the game may be implemented as a board game, a computer game, or dedicated video gaming device.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a card game, comprising:

providing a pair of players for a game;

placing an initial wager by each player on the outcome of the game;

making a challenge device available to at least one of the pair of players to increase an amount being waged on the outcome of the game, the challenge device being an object;

initiating a round of play, each round of play comprising a plurality of hands, each hand comprising:

dealing a number of cards to each player;

placing an initial bet on the outcome of the hand by a first one of the players;

presenting, by one of the players to the other of the players, the challenge device to increase the initial wager on the outcome of the game;

accepting or refusing the challenge device by the first player;

if the challenge device is refused by the player, forfeiting the initial wager and any subsequent wagers by the refusing player and ending the game; and if the challenge device is accepted by the first player, increasing the wager of both the first and second players by the appropriate amount and continuing the game until a winner of the game is determined; and wherein if the challenge device is accepted, the wager of both the first player and the second player on the outcome of the game is increased by a predetermined multiple of the wager.

2. The method of claim 1 wherein the step of providing at least one of the players with the challenge device comprises providing both of the players with a challenge device.

3. The method of claim 1 wherein the challenge device comprises a doubling device for doubling the amount of the initial wager and any subsequent wagers placed on the outcome of the game; and wherein the step of increasing the wager includes doubling an amount of the wager of both the first player and the second player if the challenge device is accepted.

4. The method of claim 1 wherein the number of cards dealt to each of the players comprises' two cards.

5. The method of claim 1 wherein the first player is in the little blind position and the second player is in the big blind position.

6. The method of claim 1 wherein the first player accepts or rejects the challenge device before viewing the identities of the cards of the first player.

7. The method of claim 1 wherein, if the first player accepts the challenge device, the first player retains the challenge device for future use.

8. The method of claim 1 further comprising dealing a number of cards to a pool of community cards, turning over at least one of the community cards to reveal the identity of the at least one community card.

9. The method of claim 8 wherein the number of community cards is five, and initially three of the community cards are turned over to reveal their identities;

placing a second bet on the outcome of the hand by each of the players;

turning over at least an additional one of the community cards to reveal the identity of the at least one additional community card;

placing a third bet on the outcome of the hand by each of the players;

turning over at least an additional one of the community cards to reveal the identity of the at least one additional community card;

placing a final bet on the outcome of the hand by each of the players; and determining a winner of the hand.

10. The method of claim 1 further comprising limiting a total number of players to two players for a head-to-head competition between the two players.

11. The method of claim 1 wherein each of the rounds of play lasts for a predetermined period of time.

12. The method of claim 10 wherein a first round of play has a little blind of 100 and a big blind of 200, wherein a second round of play has a little blind of 200 and a big blind of 400, wherein a third round of play has a little blind of 300 and a big blind of 600, and wherein a fourth round of play has a little blind of 400 and a big blind of 800.

13. The method of claim 1 further comprising providing each player with an equal number of betting chips.

14. The method of claim 1 wherein the step of providing at least one of the players with the challenge device comprises providing both of the players with a challenge device;

wherein the number of cards dealt to each of the players comprises two cards;

wherein the first player is in the little blind position and the second player is in the big blind position;

wherein the first player accepts or rejects the challenge device before viewing the identities of the cards of the first player;

wherein, if the first player accepts the challenge device, the first player retains the challenge device for future use;

dealing a number of cards to a pool of community cards, turning over at least one of the community cards to reveal the identity of the at least one community card, wherein the number of community cards is five, and initially three of the community cards are turned over to reveal their identities;

placing a second bet on the outcome of the hand by each of the players;

turning over at least an additional one of the community cards to reveal the identity of the at least one additional community card, placing a third bet on the outcome of the hand by each of the players;

turning over at least an additional one of the community cards to reveal the identity of the at least one additional community card;

placing a final bet on the outcome of the hand by each of the players; and determining a winner of the hand.

15. The method of claim 14 wherein a first round of play has a little blind of 100 and a big blind of 200, wherein a second round of play has a little blind of 200 and a big blind of 400, wherein a third round of play has a little blind of 300 and a big blind of 600, and wherein a fourth round of play has a little blind of 400 and a big blind of 800.

16. The method of claim 1 wherein the predetermined multiple comprises one of a plurality of multiples marked on the challenge device.

17. The method of claim 1 wherein the predetermined multiple is determined prior to initiating the round of play.

18. The method of claim 1 wherein if the challenge device is accepted, the amount of the initial wager and any subsequent wagers are automatically increased by a predetermined multiple of the respective wager.

19. The method of claim 1 wherein the challenge device does not have a fixed wager value.

20. A method of playing a card game, comprising:

placing an initial wager by each player on the outcome of the game;

making a challenge device available to at least one of the pair of players to increase an amount being waged on the outcome of the game;

initiating a round of play, each round of play comprising a plurality of hands, each hand comprising:

dealing a number of cards to each player;

placing an initial bet on the outcome of the hand by a first one of the players;

presenting, by one of the players to the other of the players, the challenge device to increase the initial wager on the outcome of the game;

accepting or refusing the challenge device by the first player;

if the challenge device is refused by the player, forfeiting the initial wager and any subsequent wagers by the refusing player and ending the game; and if the challenge device is accepted by the first player, increasing the wager of both the first and second players on the outcome of the game by a predetermined amount equal to a maximum wager allowed for the game;

wherein, if the challenge device is accepted, play continues until one of the players acquires all betting chips provided to players of the game.

* * * * *